US008172650B2

(12) United States Patent
Caryk et al.

(10) Patent No.: US 8,172,650 B2
(45) Date of Patent: May 8, 2012

(54) AUTOMATIC SHIFT DUAL-ACTION TOOL

(75) Inventors: Paul J. Caryk, Batavia, NY (US); Mary E. Caryk, legal representative, Batavia, NY (US); Robert A Geiser, Elma, NY (US); Paul W Huber, Lancaster, NY (US)

(73) Assignee: Paul W. Huber, Alden, NY (US)

( * ) Notice: Subject to any disclaimer, the term of this patent is extended or adjusted under 35 U.S.C. 154(b) by 582 days.

(21) Appl. No.: 12/406,310

(22) Filed: Mar. 18, 2009

(65) Prior Publication Data

US 2009/0239451 A1 Sep. 24, 2009

Related U.S. Application Data

(60) Provisional application No. 61/037,425, filed on Mar. 18, 2008.

(51) Int. Cl.
*B24B 27/08* (2006.01)

(52) U.S. Cl. ..... 451/357; 451/359

(58) Field of Classification Search ..... 451/357, 451/359, 58, 270; 192/103 A; 464/42–48
See application file for complete search history.

(56) References Cited

U.S. PATENT DOCUMENTS

| | | | | |
|---|---|---|---|---|
| 3,980,977 | A * | 9/1976 | Evans | 335/76 |
| 4,516,358 | A | 5/1985 | Marton et al. | |
| RE32,729 | E * | 8/1988 | Schmitt | 188/196 D |
| RE38,606 | E * | 10/2004 | Bednar et al. | 30/394 |
| 6,929,538 | B2 * | 8/2005 | Yi | 451/359 |
| 7,713,110 | B2 * | 5/2010 | Lampka et al. | 451/357 |
| 2008/0057842 | A1 | 3/2008 | Lampka | |

FOREIGN PATENT DOCUMENTS

| | | |
|---|---|---|
| EP | 0860235 A2 | 2/1998 |
| EP | 1724057 A2 | 11/2006 |
| GB | 1095068 | 12/1967 |

* cited by examiner

*Primary Examiner* — George Nguyen
(74) *Attorney, Agent, or Firm* — Muncy, Geissler, Olds & Lowe, PLLC

(57) ABSTRACT

Tools providing automatic, smooth shifting between random orbital and rotary motion by simply increasing or decreasing force applied are taught. Exemplar is a finishing tool switchable between grinding rotary action and random orbital sanding action without powering down and without any mechanical manipulation, made possible by having a clutch mechanism affixed directly to the spindle assembly, which also eliminates the need to dissemble the tool in order to change a backup pad, saving time and money. Direct relationship between the clutch and spindle eliminates need for a specialty pad allowing for use of a variety of backup pads, reducing the cost of replacement backup pads and increasing the functionality of the dual-function tool. An additional feature is that the drive head surface is circular and large enough to encompass the device's circular clutch plate, which means that the available friction surface area of the clutch plate is efficiently utilized.

9 Claims, 3 Drawing Sheets

AUTOMATIC SHIFT DUAL-ACTION TOOL

CROSS-REFERENCE TO RELATED APPLICATIONS

This application claims the benefit of Provisional Application No. 61/037,425, filed Mar. 18, 2008.

STATEMENT REGARDING FEDERALLY SPONSORED RESEARCH OR DEVELOPMENT

Not Applicable

REFERENCE TO SEQUENCE LISTING, A TABLE OR A COMPUTER PROGRAM LISTING COMPACT DISK APPENDIX

Not Applicable

BACKGROUND

The present invention relates generally to dual-action tools and, more particularly, to a motor driven dual-action tool whereby the tool is provided with the ability to switch between axial motion functions smoothly and uninterruptedly, such as between heavy grinding rotary action and random orbital sanding action without powering down the tool and without any mechanical manipulation by the user.

The background information discussed below is presented to better illustrate the novelty and usefulness of the present invention. This background information is not admitted prior art.

A sander is a power tool generally used to smooth rough surfaces. Woodworking sanders are usually operated by electrical power, while the sanders used in auto-body repair are powered by compressed air.

Circular (also referred to as rotary) motion sanders are used for different operational functions. One use is where the motor drive imparts a continuous, high speed, simple rotary action to a backup pad fitted with a sanding or grinding disc. This form of operation is used in the heavy sanding or grinding of various materials, such as in the grinding of welds and metals used in automobile bodies.

The random orbital motion of random orbital sanders is produced by simultaneously spinning the sanding disk and moving it in an ellipse. This motion is produced by the eccentric relationship between the backup pad and the drive shaft and ensures that no single part of the abrasive material travels the same path twice. Random orbital sanders approach the speed and aggressiveness of a belt sander, while producing a finish finer than that available from a standard, slow speed, orbital finishing sander. Because of its unique random sanding action, this sander does not leave swirl marks, and it is not sensitive to the direction of the wood grain. This makes the sander especially useful for sanding two pieces of wood that meet at right angles. Random-orbit sanders use sandpaper disks and many random-orbit sanders now come with dust collectors. Random orbital sanding provides for surface preparation for finishing with paint, stain or other type final appearance.

In the past, a finisher had to use both types of sander to accomplish the job. First a rotary machine would be utilized to provide high speed grinding to cut through heavy paint, welds, and metal and then a random orbital machine is brought into play to smooth out the deep scratch marks from the previous grinding operation. Using this method was labor intensive, time consuming, and requires investing in and maintaining a two tools.

To provide for a single tool that would provide both rotary and random orbital motions, a double acting sanding tool became available. Although an improvement, this tool required its user to interrupt the sanding or grinding operation in order to mechanically manipulate the tool to change the type of action. Although this tool presented an improvement in the art, if required a user to take the time and effort to stop the tool completely in order to make the mechanical adjustments required to use the tool for an alternative function before the tool can be restarted. A succeeding improvement provided for a single tool that could perform both rotary and random orbital motion by providing a clutch assembly that allows an operator to switch the function of the apparatus from random orbital sanding to rotary grinding

SUMMARY

At the heart of the dual-action tool made according to the principles of the invention taught herein is affixing the tool's clutching mechanism directly to its spindle assembly. For example, one dual-action tool made according to the principles of the invention is a rotary action grinder/random orbital action sander has the tool's clutching mechanism attached directly to its spindle assembly instead of being attached to the backup pad. The inventor recognized that the user could exploit this design to provide for dual-action tools that smoothly and uninterruptedly switch between their axial actions, such as between heavy grinding rotary action and random orbital sanding action without powering down the tool and without any mechanical manipulation by the user. Moreover, when a backup pad needs to be replaced, instead of being required to remove and disassemble from the spindle the entire clutching mechanism, including the clutch plate, clutch actuator, and insulating washer, in addition to the backup pad, the present design only requires the removal of the backup pad in order to replace it with a new pad. Moreover, the drive head of the present invention is circular and, thus, is able to encompass the entire surface area of the device's circular clutch plate, providing for all of the available friction surface area of the clutch plate to be utilized. Furthermore, the tool of the present invention provides for the use of a choice of available styles of backup pads, as the backup pad of the present device does not require any specialized construction.

Users of presently available dual-action devices switch the function of the device from random orbital to rotary by applying an increase or decrease of power to the device, that is random orbital motion of the tools is obtained by keeping the tool running at low speeds so that the clutch plate remains disengaged, and rotary motion is obtained by running the tool at high speeds so the clutch plated remains engaged. The present inventor recognized that although this design was an improvement over prior art devices, it still did not offer the ultimate dual-action device in that there are still time consuming actions and specialty parts required to run this tool. In order to replace the backup pad of the presently available tool, its design required a user to disconnect the device's power supply and to then remove the entire clutching mechanism. And, even though the life-time of a backup pad depends a lot on how carefully a user works the device, typically a work pad of any of these tools usually lasts at most a few days. This means that about twice a week, in order to replace a pad when using the presently available tool, a worker has to remove the clutch plate, clutch actuator, and insulating washer in order to remove the pad from the spindle. Moreover, the drive head surface of this presently available tool is not circular, thus, it is not possible for the drive head surface to encompass the entire surface area of the device's circular clutch plate, which means that there is available clutch plate friction surface that cannot be utilized. Furthermore, only backup pads specifically designed for use with this tool can be utilized, as this tool requires pads having a circular collard shoulder. This means that only backup pads specific to this type of tool can be used instead of the more cost effective replacements available.

Accordingly, the present inventor was prompted to design a tool with a structure that differs from that of the presently available tool. The principles of the present invention teach dual-action tools that provide for smooth switching between heavy grinding rotary action and random orbital sanding action without powering down and without any mechanical manipulation by the user, while requiring only the removal of the backup pad instead of being required to remove and disassemble from the spindle the entire clutching mechanism, including the clutch plate, clutch actuator, and insulating washer, in addition to the backup pad. Moreover, the drive head of the present invention is circular and, thus, is able to encompass the entire surface area of the device's circular clutch plate, providing for all of the available friction surface area of the clutch plate to be utilized. Furthermore, the dual-action tool of the present invention provides for the use of a choice of available styles of backup pads, as the backup pad of the present device does not require any specialized construction.

All of these benefits are made available by providing for a device, comprising, a dual-action tool having a clutching mechanism affixed directly to a spindle assembly, so as to provide for smooth and uninterrupted switching between axial actions without powering down the tool and without any mechanical manipulation by the user, wherein the clutching mechanism further comprises a clutch plate, wherein axial actions include rotary action and random orbital motion.

Wherein the dual-action tool further comprises a spindle assembly further comprising a bearings part attached to a spindle, and further comprises a circular clutch plate.

Wherein the dual-action tool further comprises a circular drive head having the circumference of the clutch plate so as to cause the entire surface area of the drive head to encompass the entire surface area of the device's circular clutch plate providing for all available friction surface area of the clutch plate to be utilized.

Wherein the clutch plate further comprises a hexagonal aperture designed to fit about the spindle so as to correctly orient the clutch plate to the spindle providing the greatest surface area for load distribution.

Further comprising a pressure plate having a hexagonal aperture designed to fit about the spindle, wherein the pressure plate further comprises pressure fingers so arranged as to exert their greatest pressure on the clutch plate when the tool is running at full speed and wherein the pressure fingers further comprise being webbed together so as to provide the plate with strength and stability, and wherein the pressure plate further comprises guide ways between the pressure fingers arranged so as to provide flexibility to the pressure plate.

Wherein the dual-action tool is a rotary action grinder/random orbital action sander.

Further providing for a tool, comprising:

an automatic-shift dual-action rotary sanding and grinding tool further comprising:

a clutch assembly comprising:

a drive head having a shaft balancer having a planar circular bottom surface and including a rotable drive shaft;

a spindle rotably and eccentrically affixed to the drive head;

a clutch plate rotably secured concentrically on the spindle;

a pressure plate rotably secured concentrically on the spindle following the clutch plate; and a backup pad having a detachably attachable sanding or grinding pad and detachably rotably attached to the spindle following the pressure plate;

where when the tool rotates at high velocity, a webbed set of pressure fingers comprising the pressure plate that are adapted to move upwardly responsive to centrifugal force impel the clutch plate axially into engagement with the drive head surface effectively forcing the spindle to rotate in unison with the shaft, where when tool rotates at low velocity the segments release their pressure on the clutch plate providing for the spindle to rotate independent of the rotation of the shaft providing for random orbital motion of the backup pad.

Yet further, providing a method for making an automatic-shift dual-action tool, comprising:

providing for a drive head having a shaft balancer having a planar circular bottom surface and including a rotable drive shaft;

providing for a spindle;

affixing the spindle rotably and eccentrically to the drive head;

providing for a clutch plate;

affixing the clutch plate rotably concentrically on the spindle;

providing for a pressure plate affixing the pressure plate rotably concentrically on the spindle following the clutch plate;

providing a backup pad having a detachably attachable sanding or grinding pad; and affixing said backup pad and said sanding or grinding pad in a detachably rotable manner to the spindle following the pressure plate;

where when the tool rotates at high velocity, a webbed set of pressure fingers of said pressure plate that are adapted to move upwardly responsive to centrifugal force impel the clutch plate axially into engagement with the drive head surface effectively forcing the spindle to rotate in unison with the shaft, and where when the tool rotates at low velocity the pressure fingers release their pressure on the clutch plate providing for the spindle to rotate independent of the rotation of the shaft providing for random orbital motion of the backup pad.

BRIEF DESCRIPTION OF THE DRAWINGS

In order that these and other objects, features, and advantages of the present invention may be more fully comprehended and appreciated, the invention will now be described with reference to specific exemplar embodiments, which are illustrated in appended drawings, wherein like reference characters indicate like parts throughout the several figures. It should be understood that these drawings only depict preferred embodiments of the present invention and are therefore not to be considered limiting in scope. Accordingly, the manner of making and using the present invention will be described with additional specificity and detail through the use of the accompanying drawings, in which.

REFERENCE NUMERALS AND PARTS OF THE INVENTION TO WHICH THEY REFER

Figure 1:
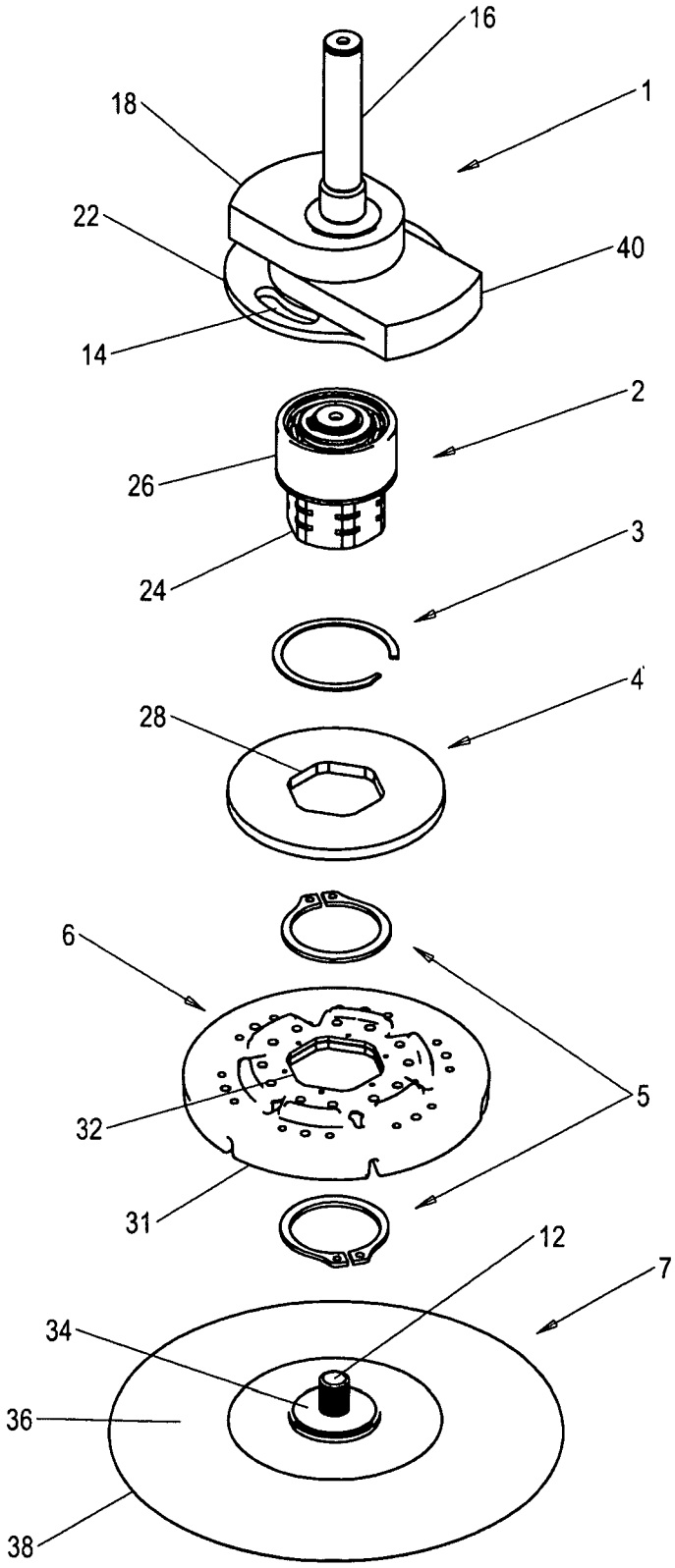
FIG. 1 is a perspective exploded view of the tool according to the principles of the present invention.

1 Shaft balancer.
2 Spindle assembly.
3 Retaining ring.
4 Clutch plate AutoSHIFT™.
5 Retaining rings.
6 Pressure plate.
7 Pad assembly AutoSHIFT™.
10 AutoSHIFT™ automatic-shift dual-function rotary sanding and grinding tool.
12 Threaded stud of backup pad.
14 Aperture.
16 Shaft of shaft balancer 1.
18 Upper lobe of shaft balancer 1.
22 Drive head plate of shaft balancer 1.
24 Spindle of spindle assembly 2.
26 Bearings of spindle assembly 2.
28 Hexagonal aperture of clutch plate 4 for fitting about spindle part 24.
30 Guideways of pressure plate 6.
31 Pressure fingers.
32 Hexagonal aperture of AutoSHIFT™ pressure plate 6 fits about spindle part 24.
34 Inner shoulder of AutoSHIFT™ back-up pad.
36 Outer shoulder of AutoSHIFT™ back-up pad.
38 Backup pad of AutoSHIFT™.
40 Lower lobe of shaft balancer 1.
50 Handle of tool.
52 Palm grip of tool.

It should be understood that the drawings are not necessarily to scale. In certain instances, details which are not necessary for an understanding of the present invention or which render other details difficult to perceive may have been omitted.

DETAILED DESCRIPTION

Tools made according to the principles of present invention are structured to have their clutch mechanism directly affixed to their spindle assembly. Such tools, referred to as the AutoSHIFT™ automatic-shift dual-function random orbital/rotary tools, provide for a dual-use single tool that can smoothly and uninterruptedly switch between different types of axial motions. As an example of a tool made by the principles of the present invention, a dual-use sanding and grinding tool is illustrated. Such a sanding and grinding tool is able to provide both heavy grinding rotary action and random orbital sanding action without powering down the tool and without any mechanical manipulation by the user. Switching between the work actions requires only an increase or decrease of hand force on the sanding device by the user. The fact that the clutch mechanism is directly affixed to the spindle assembly of the illustrated tool, the process required for replacing a backup pad is made straightforward, simple, and rapid, as now only the removal of the backup pad is required, thus, eliminating the need remove the spindle from the tool to disassemble the entire clutching mechanism, including the clutch plate, clutch actuator, and insulating washer, in addition to the backup pad. Moreover, the drive head of the present invention is circular and, thus, is able to encompass the entire surface area of the device's circular clutch plate, providing for all of the available friction surface area of the clutch plate to be utilized. Furthermore, the tool of the present invention provides for the use of a choice of available styles of backup pads, as the backup pad of the present device does not require any specialized construction.

Now, referring with more particularity to the drawings. It should be noted that the disclosed invention is disposed not only to the embodiments described by way of example, but to others in various sizes, shapes, and forms.

FIG. 1, a perspective exploded view, illustrates the elements and construction of an automatic-shift dual-function rotary/random orbital motion sanding and grinding tool 10 (see FIG. 4, for an exemplar tool) made according to the principles of the present invention. The drive mechanism is comprised of shaft balancer 1, which comprises shaft 16, upper lobe 18, lower lobe 40, and circularly shaped drive head plate 22 with apertures 14. Apertures 14 provide access to the lock ring for removing the motor from the motor housing. Shaft 16 provides for connection of the dual-action tool to a drive of choice, for example a pneumatic drive. Upper lobe 18 partly rests on and partly extends out over lower lobe 40. Circularly shaped drive head plate 22, similar to a lower lip extension, extends out from and below lower lobe 40, which, to continue the lip analogy, would be analogous to an upper lip construction. The upper lobe 18 and lower lobe 40 are needed to bring the tool into balance by creating a three component balance. As backup pad 7 orbits in one direction, lower lobe 40 orbits in a 180 degree opposite direction, but because lower lobe 40 is in a different plane than backup pad 7, upper lobe 18 is required to create a couple-weight that brings the assembly into rotational balance. Connected to the drive mechanism is spindle assembly 2 comprising spindle 24 and single double row bearing 26. Spindle assembly 2 is inserted into a receiving pocket in shaft balancer 1 to provide contact of the outer race of bearings 26 to shaft balancer 1. Single double row bearing 26 of spindle assembly 2 supports spindle 24 eliminating the need for a plurality of bearings.

The clutching mechanism consists of retaining ring 3, clutch plate 4, first retaining ring 5, pressure plate 6, and second retaining ring 5. The circularly shaped drive head plate 22 of shaft balancer 16 is designed with the same circumference as that of clutch plate 4, which combination of circular shape and size of circumference providing for the entire surface area of the drive head to encompass the entire surface area of the device's circular clutch plate to provide for all of the available friction surface area of the clutch plate to be utilized. Moreover, hexagonal aperture 28 of clutch plate 4 is designed to fit about spindle 24 correctly orienting clutch plate 4 to spindle 24 providing the greatest surface area for load distribution. Hexagonal aperture 32 of pressure plate 6 also is designed to fit about spindle 24 to provide the greatest surface area for load distribution.

Figure 1A:
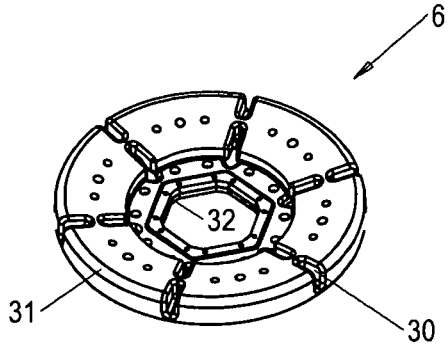
FIG. 1*a* is a perspective view of the underside of the pressure plate tool made according to the principles of the present invention.

In addition to hexagonal aperture 32, pressure plate 6 comprises pressure fingers 31 and guide ways 30. When a tool is running at full speed, pressure fingers 31, due to the upwards pressure of centrifugal force, exert their greatest pressure on clutch plate 4. As can be seen, in this example pressure fingers 31 are webbed together for strength and stability. By having the pressure fingers webbed into a one piece structure also prevents the pressure fingers 31 from acting like piano keys on the backup pad 38. FIG. 1*a*, a perspective view, illustrates the underside of pressure plate 6 made according to the principles of the present invention, to better show the structural relationship of pressure fingers 31 and guide ways 30. Pressure fingers 31 provide flexibility to pressure plate 6.

As mentioned above, when the tool is running at full speed, pressure fingers 31, due to the upwards pressure of centrifugal force, exert their greatest pressure on clutch plate 4. The pressure on clutch plate 4, in turn, prevents spindle assembly 2 from rotating providing for rotary motion through the coupled action of the friction force between the clutch plate 4 and the drive head plate 22 and prohibiting the possibility of random orbital motion by not allowing the spindle assembly 2 from rotating. As a user presses the tool against the surface being worked, the speed of rotation decreases, this causes pressure fingers 31 of pressure plate 6 to relax, causing, in turn, the frictional force between drive head plate 22 and clutch plate 4 to decrease. When the frictional force between drive head plate 22 and clutch plate 4 decreases to a point where the spindle assembly 2 can freely rotate the tool automatically shifts into a random orbital sanding action. The random orbital sanding action can be described as a slow circular motion combined with an orbital motion. That is, as backup pad 7 spins, it also orbits slightly off-center around a central point.

Backup pad 7, with threaded stud 12, outer shoulder 36, and inner shoulder 34 completes the tool. Inner shoulder 34 is thicker than the outer shoulder 36 which provides for outer shoulder 36 to flex slightly during use. It is important to note that, the design of present invention provides for the clutching mechanism to be affixed to spindle assembly 2 and not to backup pad 7. In presently available devices, each time the backup pad requires replacing, not only does the backup pad have to be removed from the tool, but the entire clutching mechanism, including the clutch plate, clutch actuator, and insulating washer must be disassembled and removed from the spindle, a process that requires a significant amount of effort, work time, and wear and tear on the elements being removed and reassembled each time the pad is replaced. In comparison, whenever the backup pad of the present invention requires replacement, only backup pad 7 needs to be removed, thus saving considerable effort, time, and wear and tear on the elements themselves. Another advantage of the present invention is that its simplified design eliminates the need to use specially designed backup pads that are required by the tools of others when replacing the backup pad. The present invention provides for the use of a number of styles of backup pad, such as low profile backup pads. This increases the number of applications for which the tool may be used and significantly decreases replacement cost.

Figure 2:
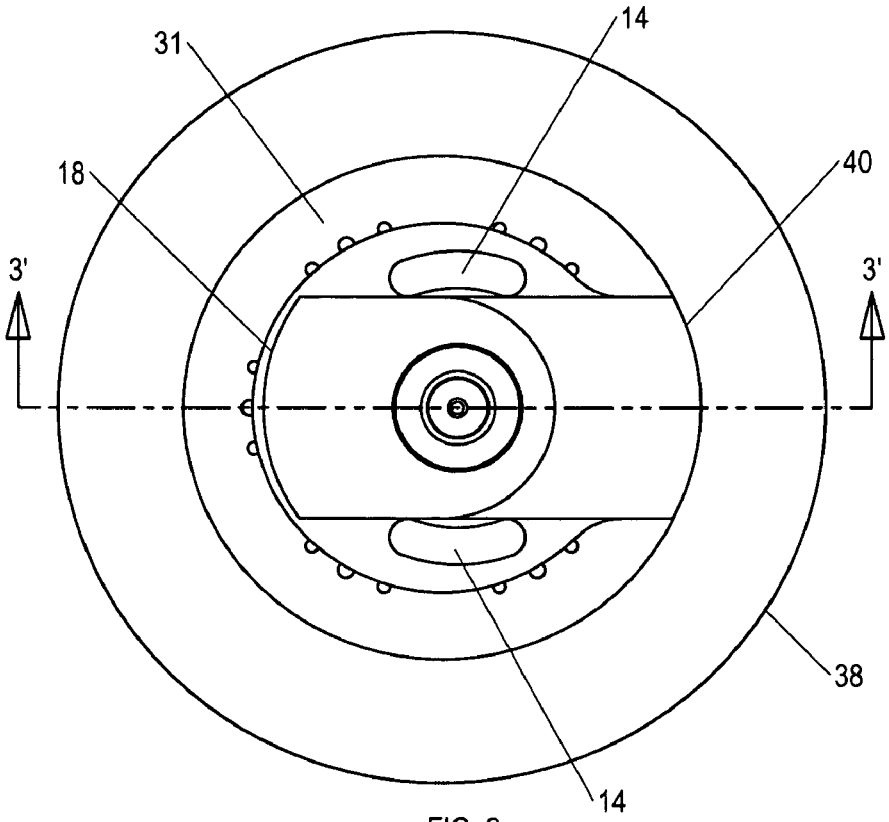
FIG. 2 is a top plan view of the assembled tool.

FIG. 2, a top plan view, further illustrates the construction of and relationship between upper lobe 18 and lower lobe 40, and of pressure plate 6 and back-up pad 38 when the tool is assembled.

Figure 3:
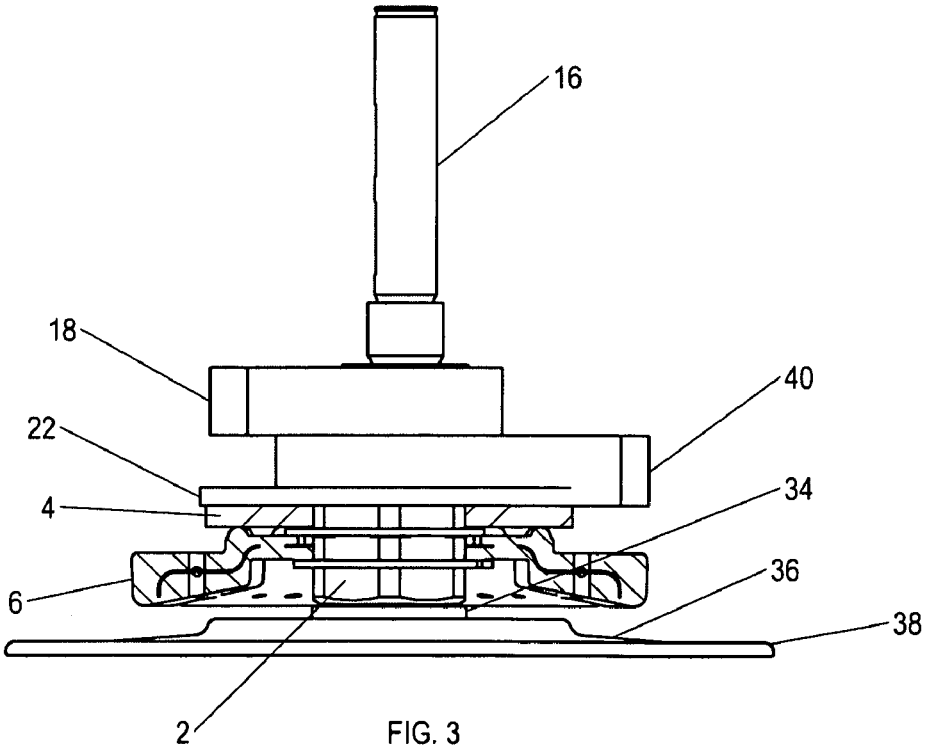
FIG. 3 is a plan view, partly in cross-section, taken along 3'-3' of FIG. 2, to illustrate the clutch assembly in a disengaged position for random orbital sanding.

FIG. 3 offers a partial cross-sectional view taken along 3'-3' of FIG. 2, to illustrate the clutch assembly in the disengaged position, that is, where the frictional force between drive head plate 22 and clutch plate 4 is at a point where the spindle assembly 2 to freely rotate.

Figure 4:
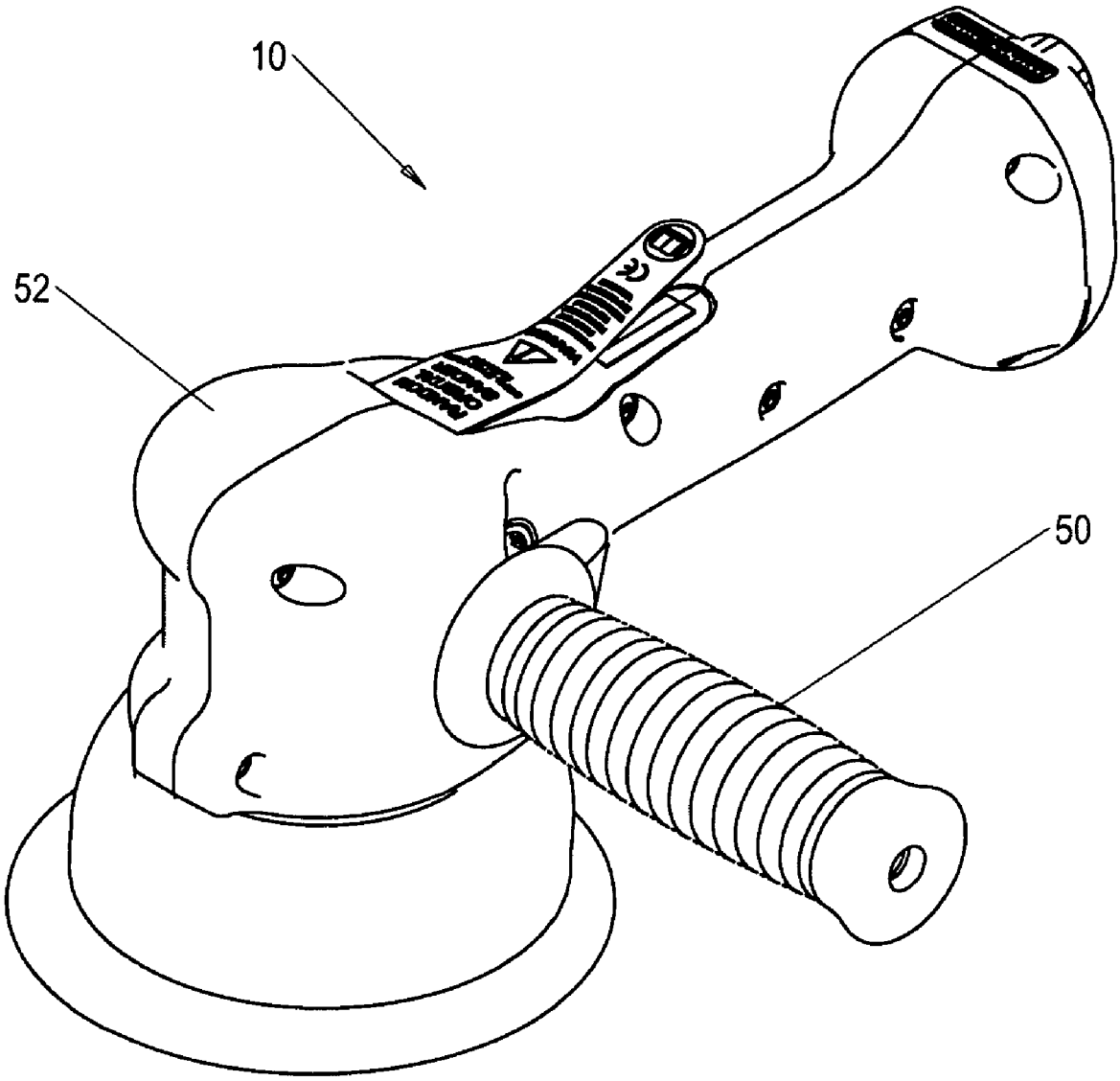
FIG. 4 is an isometric view of the tool in its ready-to-use form.

FIG. 4, a perspective view, illustrates one example of a tool that benefits from automatic-shift dual-function rotary/random orbital motion sanding and grinding tool 10 according to the principles of the present invention. A user simply increases or decreases the force on a tool, as is shown in FIG. 4, to switch from motion to motion.

Thus, it has been shown that tools made according to the present invention provide for automatic, smooth shifting between random orbital and rotary motion by simply increasing or decreasing the force applied to the sanding device by a user. This invention then provides for a single tool that switches between types of axial action, such as heavy grinding rotary action and random orbital sanding action without powering down the tool and without any mechanical manipulation by the user. Although this automatic, smooth shifting between one motion and a different motion is herein explained using a rotary/random orbital sanding device, those of ordinary skill in the trade will appreciate how this structure will allow for switching between other types of motion, such as those motions required by an automatic transmission or a centrifugal clutch. The ability to switch between axial actions was shown to be made possible by the Autoshift™ clutch mechanism that is unique to the art in that the clutch mechanism is affixed directly to the spindle assembly. This structure also eliminates the need to dissemble the tool in order to change a backup pad, saving both time and money. Also, importantly, because of the direct relationship between the clutch and spindle assembly, there in no longer a need to use a specialty backup pad allowing for the use of a variety of backup pads, thus reducing the cost of obtaining a replacement backup pad and increasing the functionality of the dual-function tool. An additional feature of the newly designed drive head, the drive head surface is circular and large enough to encompass the device's circular clutch plate, which means that the available friction surface area of the clutch plate is efficiently utilized.

The foregoing description, for purposes of explanation, uses specific and defined nomenclature to provide a thorough understanding of the invention. However, it will be apparent to one skilled in the art that the specific details are not required in order to practice the invention. Thus, the foregoing description of the specific embodiment is presented for purposes of illustration and description and is not intended to be exhaustive or to limit the invention to the precise form disclosed. Those skilled in the art will recognize that many changes may be made to the features, embodiments, and methods of making the embodiments of the invention described herein without departing from the spirit and scope of the invention. Furthermore, the present invention includes all the variation, methods, modifications, and combinations of features within the scope of the appended claims, thus the invention is limited only by the claims.

What is claimed is:

1. An automatic-shift dual-action tool providing smooth and uninterrupted switching between axial actions without turning off and without any mechanical manipulation by a user, comprising:

a shaft balancer, including a rotatable shaft, an upper lobe and a lower lobe that are partly stacked where the shaft is located to provide balance, and a drive head plate at a bottom surface of the shaft balancer;

a spindle assembly which is eccentrically connected with the shaft balancer and includes a spindle rotatably affixed to the shaft;

a clutch plate and a pressure plate that are rotatably and concentrically coupled on the spindle in sequence; and a backup pad rotatably and detachably connected with the spindle assembly through a threaded stud formed on a top surface thereof;

wherein when the automatic-shift dual-action tool operates at a high velocity, the pressure plate is rotated upwards to drive the clutch plate to engage with the drive head plate via centrifugal force so that the backup pad is rotated in unison with the spindle and the shaft of the shaft balancer to perform rotary grinding operation; and wherein when the automatic-shift dual-action tool operates at a low velocity, the pressure plate releases pressure on the clutch plate to disengage the pressure plate and the clutch plate from the spindle so that the backup pad is rotated in unison with the spindle and the shaft of the shaft balancer to perform random orbital sanding operation.

2. The automatic-shift dual-action tool of claim 1, wherein the spindle assembly includes at least one bearing attached to the spindle.

3. The automatic-shift dual-action tool of claim 1, wherein the drive head plate is formed at a diameter greater than that of the clutch plate to provide entire coverage and friction area between them.

4. The automatic-shift dual-action tool of claim 1, wherein the clutch plate includes a first hexagonal aperture corresponding to the shape of the spindle.

5. The automatic-shift dual-action tool of claim 4, wherein the pressure plate includes a second hexagonal aperture corresponding to the first hexagonal aperture of the clutch plate and the shape of the spindle.

6. The automatic-shift dual-action tool of claim 1, wherein the pressure plate includes a plurality of pressure fingers to exert pressure on the clutch plate during the high velocity operation of the automatic-shift dual-action tool.

7. The automatic-shift dual-action tool of claim 6, wherein the pressure plate includes a plurality of guide ways between the plurality of pressure fingers to provide flexibility to the pressure plate.

8. The automatic-shift dual-action tool of claim 1, wherein the backup pad is a grinding pad.

9. The automatic-shift dual-action tool of claim 1, wherein the backup pad is a sanding pad.

* * * * *